United States Patent [19]

Kuenzle et al.

[11] 4,072,832

[45] Feb. 7, 1978

[54] CONTROL ELECTRODE FOR HIGH-VOLTAGE APPARATUS

[75] Inventors: Paul Küenzle; Ulrich Baumgärtl, both of Berlin, Germany

[73] Assignee: Siemens Aktiengesellschaft, Munich, Germany

[21] Appl. No.: 608,756

[22] Filed: Aug. 28, 1975

[30] Foreign Application Priority Data

Sept. 3, 1974 Germany ..... 2442405

[51] Int. Cl.[2] ..... H01H 9/30; H01H 33/02

[52] U.S. Cl. ..... 200/48 R; 174/144; 200/144 C; 313/239; 313/313

[58] Field of Search ..... 174/73 R, 73 SC, 127, 174/144; 200/305, 48 R, 48 P, 48 KB, 48 V, 48 SB, 48 CB, 144 C; 338/114; 313/239, 313

[56] References Cited

U.S. PATENT DOCUMENTS

| | | | |
|---|---|---|---|
| 2,305,717 | 12/1942 | LaBell | 338/114 |
| 2,472,214 | 6/1949 | Hurvitz | 338/114 |
| 2,734,978 | 2/1956 | Bulgin | 338/114 |
| 3,634,604 | 1/1972 | Lusk | 174/73 R |
| 3,796,821 | 3/1974 | Lusk | 174/73 R |
| 4,011,426 | 3/1977 | Lange | 200/144 C |

FOREIGN PATENT DOCUMENTS

| | | | |
|---|---|---|---|
| 1,465,966 | 5/1969 | Germany | 338/114 |
| 755,374 | 8/1956 | United Kingdom | 174/73 R |

*Primary Examiner*—Thomas J. Kozma

*Attorney, Agent, or Firm*—Kenyon & Kenyon, Reilly, Carr & Chapin

[57] ABSTRACT

The invention is directed to a control electrode for high-voltage apparatus which alters the electric field in the vicinity of the voltage-carrying parts. The control electrode includes a formed body of a conductive plastic foam material. The control electrode is suitable, for example, for multipole medium-voltage switching apparatus wherein the pole spacing can be reduced with the air of control electrodes of the invention.

7 Claims, 8 Drawing Figures

CONTROL ELECTRODE FOR HIGH-VOLTAGE APPARATUS

BACKGROUND OF THE INVENTION

In high-voltage technology, the problem frequently arises to modify the electric field in the vicinity of voltage-carrying components with sharp edges in such a manner that the field strength is reduced and preliminary discharges are avoided. For this purpose, it is known to use control electrodes which are large-area conducting parts having rounded edges. These parts are arranged in the vicinity of the components with sharp corners and are electrically connected therewith and thereby equalize the electric field in the vicinity of the components. Control electrodes of this kind permit the use of high-voltage apparatus of given dimensions for a higher voltage.

The fabrication of control electrodes is relatively expensive because of the required large curvature radii, in the case of large parts, must be produced by pressing or drawing of sheet metal or by casting processes and mechanical machining in the case of smaller parts. The use of control electrodes in high-voltage technology has therefore been limited heretofore to special cases.

Accordingly, it is an object of the invention to provide such control electrodes which can be economically produced to thereby make possible the general use of control electrodes in high-voltage technology.

SUMMARY OF THE INVENTION

According to a feature of the invention, the control electrode includes a formed body of a conductive plastic foam material. Foam materials of this kind are commercially available in different forms. The raw material can be formed into pieces of almost any desired shape by simple machining operations such as by cutting. In addition, there is the possibility of free-forming by bending. The formed foam material bodies can be fastened to metal parts by cementing. This has been found by experience to produce a conducting connection between the foam material and the metal without special measures. However, conductive adhesives may also be used. Because of the little effort which is required in the fabrication of the new control electrodes, the stress at critical points in high-voltage apparatus and high-voltage installations can be reduced and thus, better utilization achieved.

In another embodiment of the invention, the control electrode can include a hollow structure consisting of insulating material and an electrically conductive plastic foam material filling the hollow structure as well as by an electrical connecting conductor connected with the foam material. Hollow insulating structures can be fabricated inexpensively in many shapes. It is already known to improve the dielectric strength of control electrodes by an outer insulating layer. Here, reference may be had to Deutsche Offenlegungsschrift No. 1,916,094. In this connection, it is known, for instance, to insulate a metal casting on all sides by immersion in liquid plastic. Here, however, air occlusions happen frequently within the plastic layer or between the plastic layer and the metal body. This has an adverse effect on the durability of the control electrodes because the plastic is decomposed by corona discharges in the vicinity of the air occlusions.

According to a further embodiment of the invention, these difficulties can be avoided by making the necessary hollow insulating structures of a thermo-plastic material by a blowing process. Because one starts out here with prefabricated films or sheets of insulating material, the hollow structures are smooth and free of bubbles, which has a favorable effect on the behavior in electric fields.

The opening of the hollow insulating structures provided for introducing the conductive foam material may be formed by a protrusion which corresponds to the desired opening and is removed by a mechanical process. The opening is therefore made by cutting the hollow structure open in the neighborhood of the protrusion or by milling the same off.

The conductive foam material, which forms the control electrode proper, can be introduced into the hollow structure in different ways. For instance, a cushion can be cut from a slab of conductive foam material and inserted through the opening of the hollow structure. It is advisable here to select an elastically deformable foam material which, after passing through the opening of the hollow structure, expands due to its elasticity and fills the hollow structure, smoothly lying against it. Conductive plastic foam materials suited for these purposes are commercially available. A further possibility of introducing the conductive foam material into the hollow structure is to fill the hollow structure with a conductive plastic which is made to foam within the former. A number of methods are known for this purpose, which makes hard as well as elastically resilient plastic foam materials. The foaming can take place without pressure as well as by applying pressure of greater or smaller magnitude, as well as with or without application of heat. Suitable raw materials and processes for the foaming may be found, for instance, in the book *Kunststoff-Schaumstoffe* by Homann, Carl Hanser Verlag, Munich 1966.

If the conductive plastic is foamed within the hollow structure, the advantageous possibility exists to embed the fastening elements for the control electrode in the foam material being formed. This eliminates a later attachment of the fastening elements by means of screws, rivets or otherwise.

Although the invention is illustrated and described herein as a control electrode for high-voltage apparatus, it is nevertheless not intended to be limited to the details shown, since various modifications may be made therein within the scope and the range of the claims. The invention, however, together with additional objects and advantages will be best understood from the following description and in connection with the accompanying drawings.

DESCRIPTION OF THE PREFERRED EMBODIMENTS OF THE INVENTION

Figure 1:
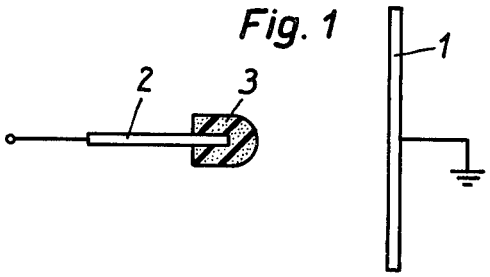
FIG. 1 is a schematic diagram of a control electrode according to the invention for an electrical component with sharp corners.

A basic arrangement frequently occurring in high-voltage technology is shown in FIG. 1 wherein a grounded, plate-shaped electrode 1 is provided and a stick-shaped or rod-shaped electrode 2 is arranged perpendicular to the plate and is at high-voltage potential. At the tip of the electrode 2 facing the plate 1, there is a relatively high field strength so that predischarges occur from the tip of the electrode 2 if sufficient voltage is applied to the arrangement.

By means of a control electrode 3, which consists of a foam-material body 3 covering the tip or edge of the electrode 2, the dielectric strength of the arrangement can be increased substantially because the radius of curvature is enlarged and the field strength thereby reduced. To form the control electrode 3, a plane piece cut from a sheet of conductive plastic foam material, for instance, can be bent around the edge of the electrode 2 and joined to the electrode 2 by cementing. The desired large radius of curvature is thereby formed. In this manner, the stress at critical points of a high-voltage switching apparatus, for instance, can be reduced.

In the following and according to further embodiments of the invention, an insulated control electrode will be described wherein a conductive foam material is arranged in a hollow structure of insulating material.

Figure 2:
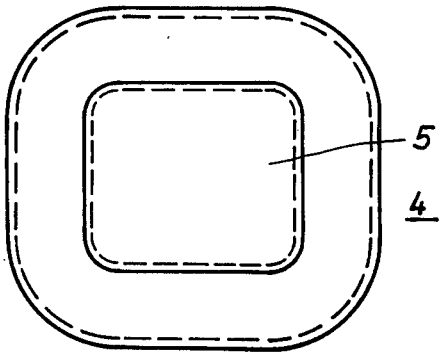
FIG. 2 is a plan view of a hollow structure made from plastic material by the blowing process in a top view and in cross section.
Figure 3:
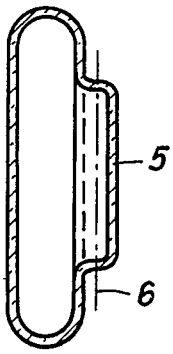
FIG. 3 is a section view of the hollow structure shown in FIG. 2.
Figure 6:
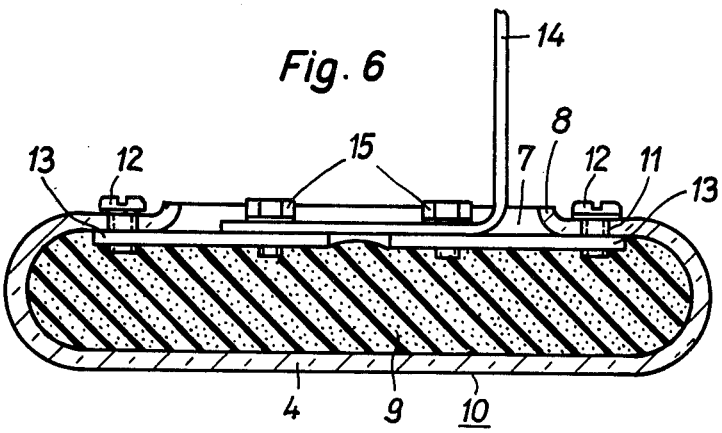
FIG. 6 shows, in cross-section, an insulated control electrode with fastening parts.

The hollow structure 4 according to FIGS. 2 and 3 has a flat shape, rounded on all sides. On one of the flat sides, the hollow structure 4 has a protrusion 5, through the removal of which by cutting or milling along the dash-dotted line 6, for instance, an opening 7 (FIG. 6) is formed, which is surrounded by an upright border 8 (FIG. 6). The hollow structure 4 can be fabricated, for instance, of polyethylene by a blowing process. To obtain sufficient mechanical stability, it is advisable to make the hollow structure 4 with a wall thickness in the order of millimeters.

Figure 4:
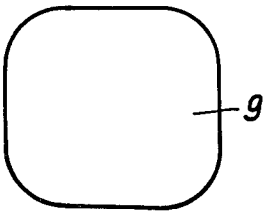
FIG. 4 shows a cushion of conductive foam material which can be placed in the hollow structure according to FIGS. 2 and 3.
Figure 5:
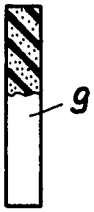
FIG. 5 is another view, partially in section, of the cushion shown in FIG. 4.

To form the control electrode, a cushion 9 of conductive foam material according to FIGS. 4 and 5 is placed in the hollow structure according to FIGS. 2 and 3. The corners of the cushion 9 are rounded according to the inside shape of the hollow structure 4. If the foam material used is sufficiently deformable elastically, it suffices to round the cushion along one axis. Commercially available conductive foam materials have this deformability and contain a conductive substance which gives to the foam material a resistivity of about $10^3$ ohm-cm. If it is desired or necessary, the foam material can be given a higher or lower resistivity by a suitable treatment.

A finished control electrode 10 is shown in FIG. 6. It will be seen that the cushion 9 fills the hollow structure 4 tightly and thereby forms a control electrode rounded on all sides. The latter is insulated on all sides by the hollow stucture 4, so that the control electrode has greater dielectric strength. To attach the control electrode 10 to an equipment, the hollow structure 4 is provided in the vicinity of the border 8 surrounding the opening 7 with holes 11, through which fastening screws 12 for two holding plates 13 extend. A mounting bracket 14 is connected with both holding plates 13 by screws 15. Other designs can also be used for the fastening means, for example, one-piece fastening devices which can detent in prepared recesses in the hollow structure 4 by a snap-in connection. In any case, however, a reliable electrical contact between the fastening members and the cushion 9 of conductive foam material must be assured.

Figure 7:
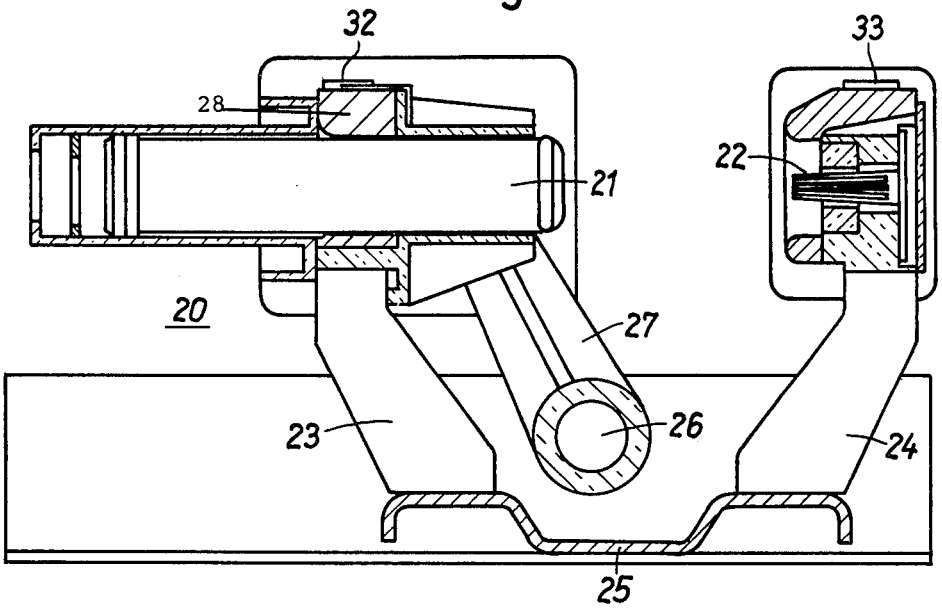
FIGS. 7 and 8 illustrate how control electrodes according to the invention can be applied in a load disconnect switch.
Figure 8:
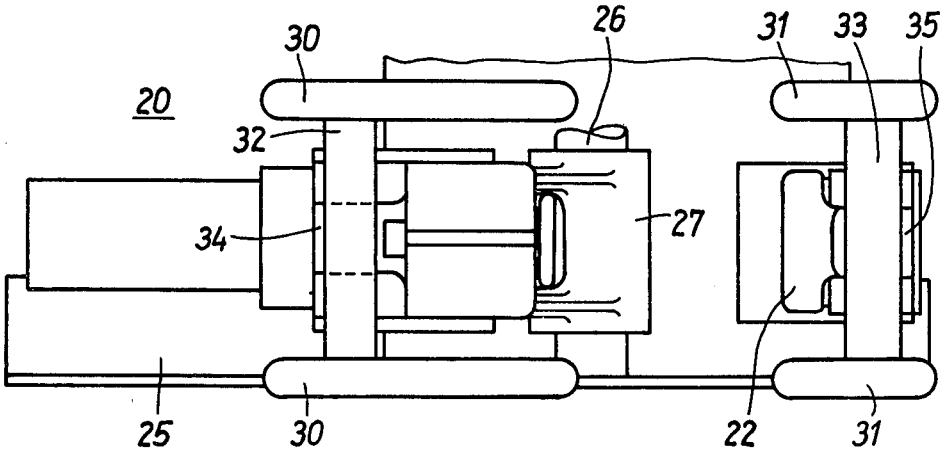

In FIGS. 7 and 8, a load disconnect switch 20 is shown in simplified form. The movable contact 21 and the stationary contact 22 are each supported by support insulators 23 and 24, respectively, which are fastened on a base frame 25, which also carries the actuator elements of the load disconnect switch. In the figures, the movable contact 21 is shown in the "off" position. For switching on, the movable contact 21 is moved to the right by a shaft 26 and a lever 27 mounted thereon and brought into engagement with the stationary contact 22.

For equalizing the electric field in the vicinity of the carrier 28 of the movable contact 21 and in the vicinity of the stationary contact 22, two pairs of control electrodes 30 and 31 are provided, respectively. The electrodes of each pair are arranged on both sides of the contacts as shown in FIG. 8 and are of rectangular or square shape, depending on the dimensions of the contacts, and whose assembly corresponds to the control electrode 10 according to FIG. 6. The control electrodes 30 and the control electrodes 31 are connected with each other by mounting bars 32 and 33, respectively, which are in electrically conducting connection with the connecting devices 34 and 35 of the contacts 21 and 22, respectively. The control electrodes permit the use of the load disconnect switch 20 with given dimensions for a higher rated voltage or to increase its voltage safety margin, particularly for pulse voltages. This applies to the switching gap as well as to the distance to adjacent poles of identical configuration of a multipole switching apparatus. For different shapes of the areas to be shielded, circular or oval control electrodes, for instance, can also be used.

While the embodiment examples described were based on hollow structures made by a blowing process, such hollow structures can be made also by first fabricating shells by a pressing or drawing process and then joining them together in a suitable manner. Here, a cushion of conductive foam material can be introduced through an opening of the hollow bodies in the manner already described. By starting out with half-shells, the conductive foam material can be inserted between the half-shells before they are joined together. As already mentioned, it is also possible to make the foam material only inside the hollow plastic structure by introducing a foamable liquid plastic. The desired electric conductivity is obtained in this case by admixing a suitable conductive substance, for example, graphite powder or metal in the form of a very fine powder, to the liquid plastic. The foaming of the hollow structure provides the possibility to attach in one operation also the fastening members for the control electrode. For this purpose, so-called hard foam can be used to ensure sufficient anchoring of the fastening members.

What is claimed is:

1. In a high-voltage switching apparatus wherein an electric field is present between parts of the switching apparatus separated by an insulating gas, the improvement comprising: a control electrode comprising: a body of conductive plastic foam material mounted so as to lie in said electric field, said body being formed to have a contour for reducing the intensity of said electric field.

2. In a high-voltage switching apparatus in accordance with claim 1, the improvement wherein:

said control electrode further includes a hollow structure made of insulating material;

said body of plastic foam material fills out the interior of said hollow structure; and, said control electrode further includes electrical connecting means electrically connected to said body.

3. In a high-voltage switching apparatus in accordance with claim 2, the improvement wherein, said hollow structure is made of a thermo-plastic synthetic material.

4. In a high-voltage switching apparatus in accordance witn claim 3, the improvement wherein, said hollow structure has a protrusion formed thereon defining an opening in said hollow structure communicating with the interior thereof.

5. In a high-voltage switching apparatus in accordance with claim 2, the improvement wherein, said body of electrically conductive plastic foam material is elastically deformable and is contoured so as to have the shape of a pillow.

6. In a high-voltage switching apparatus in accordance with claim 2, the improvement wherein, said body is made of a foamable electrically conductive plastic foam material filling out and being hardened in said hollow structure.

7. In a high-voltage switching apparatus in accordance with claim 6, the improvement wherein, said electrically connecting means comprises fastening elements embedded in said body.

* * * * *